US011634968B2

(12) United States Patent
Sladic

(10) Patent No.: US 11,634,968 B2
(45) Date of Patent: Apr. 25, 2023

(54) OUTFLOW CONTROL DEVICE, SYSTEMS AND METHODS

(71) Applicant: WEATHERFORD TECHNOLOGY HOLDINGS, LLC, Houston, TX (US)

(72) Inventor: John S. Sladic, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/207,606

(22) Filed: Mar. 20, 2021

(65) Prior Publication Data

US 2021/0207453 A1 Jul. 8, 2021

Related U.S. Application Data

(62) Division of application No. 16/417,399, filed on May 20, 2019, now Pat. No. 10,982,507.

(51) Int. Cl.

| | |
|---|---|
| ***E21B 34/10*** | (2006.01) |
| ***E21B 33/126*** | (2006.01) |
| ***E21B 43/04*** | (2006.01) |
| ***E21B 43/08*** | (2006.01) |

(52) U.S. Cl.

CPC ..... *E21B 34/10* (2013.01); *E21B 33/126* (2013.01); *E21B 43/045* (2013.01); *E21B 43/08* (2013.01); *E21B 2200/06* (2020.05)

(58) Field of Classification Search

CPC ..... E21B 33/126; E21B 34/10; E21B 43/045; E21B 43/08; E21B 2200/06

See application file for complete search history.

(56) References Cited

U.S. PATENT DOCUMENTS

| | | | | |
|---|---|---|---|---|
| 4,512,886 A * | 4/1985 | Hicks | F03B 13/189 | 210/170.05 |
| 4,907,655 A * | 3/1990 | Hromas | E21B 34/063 | 166/317 |
| 5,335,731 A * | 8/1994 | Ringgenberg | E21B 23/006 | 166/336 |
| 5,765,641 A * | 6/1998 | Shy | E21B 23/00 | 166/292 |
| 6,302,216 B1 * | 10/2001 | Patel | E21B 21/103 | 166/375 |

(Continued)

OTHER PUBLICATIONS

Weatherford; "FloReg Autonomous Inflow Control Device", Tech Specs, Sand Control, article No. 12750.00, dated 2017, 2 pages.

(Continued)

*Primary Examiner* — Aaron L Lembo

(74) *Attorney, Agent, or Firm* — Smith IP Services, P.C.

(57) ABSTRACT

A well tool assembly can include a well screen configured to filter fluid flow between an interior and an exterior of a tubular string, and an outflow control section that permits the fluid flow in an outward direction and prevents the fluid flow in an inward direction, the outflow control section including at least two outflow control valves arranged in series. A method can include installing a well tool assembly including a well screen, flowing a fluid from an exterior to an interior of a tubular string through the well screen and an inflow control valve of the well tool assembly, and flowing another fluid from the interior to the exterior of the tubular string through the well screen and at least one outflow control valve of the well tool assembly.

15 Claims, 5 Drawing Sheets

(56) References Cited

U.S. PATENT DOCUMENTS

| | | | | |
|---|---|---|---|---|
| 7,264,059 | B2 * | 9/2007 | Akselberg | E21B 23/04 166/373 |
| 7,516,792 | B2 * | 4/2009 | Lonnes | E21B 23/04 166/308.1 |
| 8,701,778 | B2 * | 4/2014 | Ringgenberg | E21B 34/08 166/319 |
| 8,752,635 | B2 * | 6/2014 | Wang | E21B 17/1035 166/380 |
| 8,978,750 | B2 * | 3/2015 | Noske | E21B 47/12 166/66.6 |
| 9,163,481 | B2 * | 10/2015 | Noske | E21B 23/06 |
| 9,260,927 | B2 * | 2/2016 | Hannegan | B63B 35/4413 |
| 9,334,711 | B2 * | 5/2016 | Hannegan | E21B 21/00 |
| 9,353,587 | B2 * | 5/2016 | Bansal | E21B 21/10 |
| 9,404,346 | B2 * | 8/2016 | Gray | E21B 33/085 |
| 9,416,599 | B2 * | 8/2016 | Bailey | E21B 7/00 |
| 9,416,620 | B2 * | 8/2016 | Hannegan | E21B 34/06 |
| 9,494,013 | B2 * | 11/2016 | Ringgenberg | E21B 43/12 |
| 9,518,445 | B2 * | 12/2016 | Noske | E21B 21/103 |
| 9,518,452 | B2 * | 12/2016 | Turley | E21B 43/10 |
| 9,534,461 | B2 * | 1/2017 | Xu | E21B 23/04 |
| 9,567,831 | B2 | 2/2017 | Ward et al. | |
| 9,784,073 | B2 * | 10/2017 | Bailey | E21B 33/085 |
| 9,828,838 | B2 | 11/2017 | Lopez et al. | |
| 9,903,187 | B2 * | 2/2018 | Robison | F04B 47/02 |
| 9,995,109 | B2 | 6/2018 | Least et al. | |
| 10,036,215 | B2 * | 7/2018 | Wood | E21B 19/07 |
| 10,053,943 | B2 * | 8/2018 | Hannegan | E21B 33/068 |
| 10,094,197 | B2 * | 10/2018 | Ward | E21B 43/10 |
| 10,107,075 | B2 * | 10/2018 | Grayson | E21B 34/101 |
| 10,132,137 | B2 * | 11/2018 | McDowell | F16K 3/03 |
| 10,138,690 | B2 * | 11/2018 | Odell, II | E21B 19/07 |
| 10,167,865 | B2 * | 1/2019 | Robison | F04B 9/10 |
| 10,246,968 | B2 * | 4/2019 | Budde | E21B 23/06 |
| 10,267,117 | B2 * | 4/2019 | Bailey | E21B 33/085 |
| 10,519,747 | B2 * | 12/2019 | Purkis | E21B 23/04 |
| 10,544,647 | B2 * | 1/2020 | Scruggs | E21B 34/08 |
| 10,605,049 | B2 * | 3/2020 | Joerpeland | E21B 37/06 |
| 2011/0308817 | A1 * | 12/2011 | Ravensbergen | E21B 43/26 166/382 |
| 2012/0090847 | A1 * | 4/2012 | Getzlaf | E21B 34/10 166/305.1 |
| 2013/0020624 | A1 | 1/2013 | Huang et al. | |
| 2014/0076560 | A1 * | 3/2014 | Kenyon | E21B 34/10 166/281 |
| 2014/0318781 | A1 | 10/2014 | Kofoed et al. | |
| 2017/0107791 | A1 | 4/2017 | Nguyen | |
| 2018/0305994 | A1 * | 10/2018 | Ford | E21B 33/127 |
| 2019/0010783 | A1 * | 1/2019 | Frosell | E21B 41/0085 |
| 2019/0048684 | A1 | 2/2019 | Kao et al. | |
| 2019/0301257 | A1 * | 10/2019 | Wilson | E21B 31/1135 |

OTHER PUBLICATIONS

International Search Report with Written Opinion dated Sep. 15, 2020 for PCT Patent Application No. PCT/US2020/030659, 13 pages.

Office Action dated Apr. 29, 2020 for U.S. Appl. No. 16/417,399, 15 pages.

Office Action dated Oct. 29, 2020 for U.S. Appl. No. 16/417,399, 12 pages.

GCC Examination report dated Oct. 4, 2021 for GCC Patent Application No. 2020-39776, 5 pages.

* cited by examiner

OUTFLOW CONTROL DEVICE, SYSTEMS AND METHODS

CROSS-REFERENCE TO RELATED APPLICATION

This application is a division of prior application Ser. No. 16/417,399 filed on 20 May 2019. The entire disclosure of this prior application is incorporated herein by this reference.

BACKGROUND

This disclosure relates generally to equipment utilized in conjunction with a subterranean well and, in an example described below, more particularly provides an outflow control device, and associated systems and methods.

It is known to selectively and variably restrict production fluid flow into a tubular string in a well, for example, to balance flow from multiple producing zones. However, such production fluid flow restrictions do not provide for reverse flow, that is, injection or outward flow from the tubular string. Such injection or outward flow of fluid from the tubular string would be useful, for example, to treat (e.g., acidize, fracture, etc.) a formation penetrated by the well, to treat (e.g., acidize, consolidate, etc.) a gravel pack external to the tubular string, or for another purpose.

Therefore, it will be readily appreciated that improvements are needed in the art of controlling fluid flow between an interior and an exterior of a tubular string in a well. The present disclosure provides such improvements, which may be used for a variety of different purposes and with a variety of different well configurations.

DETAILED DESCRIPTION

Figure 1:
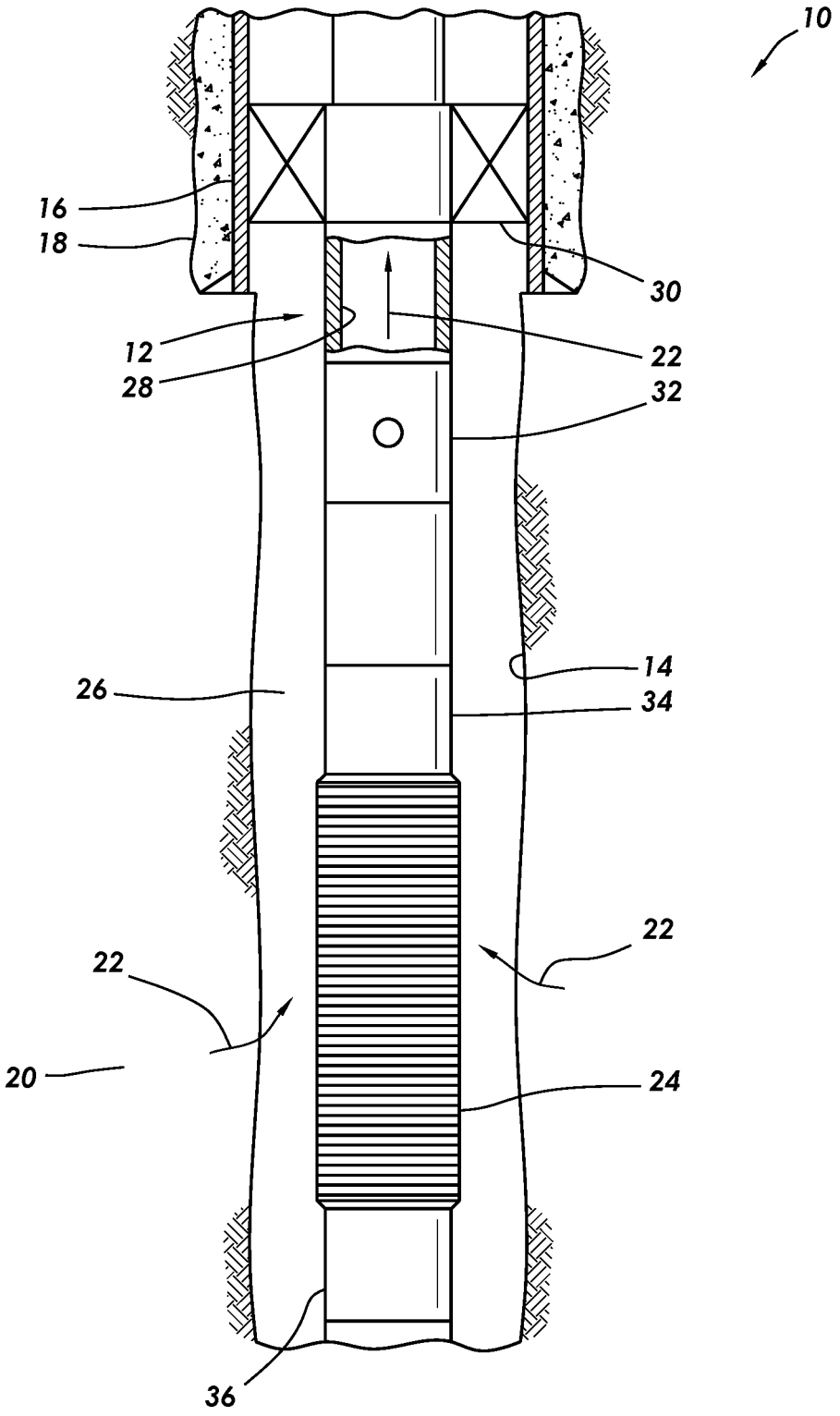
FIG. 1 is a representative partially cross-sectional view of an example of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is installed in a wellbore 14. An upper section of the wellbore 14 is lined with casing 16 and cement 18, and a lower section of the wellbore is uncased or open hole.

In other examples, the lower section of the wellbore 14 could be lined with casing and/or cement. In addition, although the wellbore 14 is depicted in FIG. 1 as being generally vertical, in other examples sections of the wellbore could be generally horizontal or otherwise inclined from vertical. Therefore, it will be appreciated that the scope of this disclosure is not limited to any particular details of the well or wellbore 14 as depicted in FIG. 1 or described herein.

The wellbore 14 penetrates an earth formation 20 from which it is desired to produce a fluid 22. For this purpose, the tubular string 12 includes a well screen 24 that filters debris, sand, fines, etc., from the fluid 22 as it flows from an exterior to an interior of the tubular string. The well screen 24 may comprise any type of screen or filter (such as, a wire-wrapped, sintered, pre-packed, slotted, perforated or other type of screen).

In the FIG. 1 example, the exterior of the tubular string 12 corresponds to an annulus 26 formed radially between the tubular string and the wellbore 14. In other examples, the annulus 26 could be formed between the tubular string 12 and another tubular string external to the tubular string 12. Thus, the scope of this disclosure is not limited to any particular arrangement of the tubular string 12 in the well, or to any particular configuration of the exterior of the tubular string 12.

The interior of the tubular string 12, as depicted in FIG. 1, corresponds to an internal flow passage 28 extending longitudinally through the tubular string. In other examples, another tubular string (such as, a coiled tubing string or another type of tubular string) could be positioned in the tubular string 12, in which case the fluid 22 could flow into an annulus formed between these tubular strings. Thus, the scope of this disclosure is not limited to any particular configuration of the interior of the tubular string 12.

The FIG. 1 tubular string 12 also includes a packer 30 and a valve 32 connected between the packer and the well screen 24. Other well tools, more or less well tools, and different combinations of well tools may be connected in the tubular string 12 in other examples. Thus, the scope of this disclosure is not limited to any particular number, arrangement or combination of well tools in the tubular string 12.

The packer 30 in this example is a pressure-set packer that seals off the annulus 26 between the tubular string 12 and the casing 16 in response to application of an increased pressure to the flow passage 28. In other examples, a mechanically-set or other type of packer may be used for the packer 30. Such packers are well known to those skilled in the art, and so are not further described herein.

The valve 32 in this example is a sliding sleeve-type valve that selectively provides fluid communication between the interior and exterior of the tubular string 12. The valve 32 may be opened or closed in response to application of an increased pressure to the flow passage 28, or by mechanically shifting an internal sleeve (not shown) of the valve. Such pressure-actuated or mechanically-actuated valves are well known to those skilled in the art, and so are not further described herein.

The valve 32 could, for example, be used to place a gravel pack (not shown) in the annulus 26 surrounding the well screen 24. However, use of the valve 32 or placement of a gravel pack about the well screen 24 is not necessary, in keeping with the principles of this disclosure.

Although only one set of the well screen 24, packer 30 and valve 32 are depicted in FIG. 1, the tubular string 12 could include any number of sets of these components or other components. For example, each set of a well screen 24 and packer 30 could be used to isolate and produce fluid 22 from a corresponding one of multiple zones penetrated by the wellbore 14.

An inflow control section 34 can be used to control flow of the fluid 22 between the exterior and the interior of the tubular string 12. If there is production from multiple zones into respective multiple well screens 24, the inflow control section 34 may be used to balance or otherwise regulate the inwardly directed flow from the zones by restricting the flow that passes into each of the screens.

In addition, an outflow control section 36 can be used to control flow of a fluid between the interior and the exterior of the tubular string 12 (for example, to treat the formation 20 or a gravel pack in the annulus 26, or for an injection operation, etc.). If there are multiple well screens 24, the outflow control section 36 may be used to balance or otherwise regulate the outwardly directed flow from the tubular string 12 into respective multiple zones by restricting the flow that passes out of each of the screens.

If, however, the packer 30 is a pressure-set packer and/or the valve 32 is pressure-actuated, it may be desirable to prevent outwardly directed fluid flow from the tubular string 12, so that pressure in the flow passage 28 can be increased as needed to accomplish setting of the packer and/or actuation of the valve. In addition, it may be undesirable to permit such outwardly directed fluid flow from passing through the inflow control section 34, for example, to avoid a possibility of plugging or eroding any components of the inflow control section during a treatment or injection operation.

Furthermore, it may be desirable to circulate fluid through the tubular string 12 during installation in the wellbore 14, but to do so without use of a wash pipe in the tubular string. The inflow and outflow control sections 34, 36 can be configured to prevent such circulating flow from passing outwardly through the screen 24, so that the fluid will flow to a distal end of the tubular string 12, and then return to surface via the annulus 26.

Figure 2:
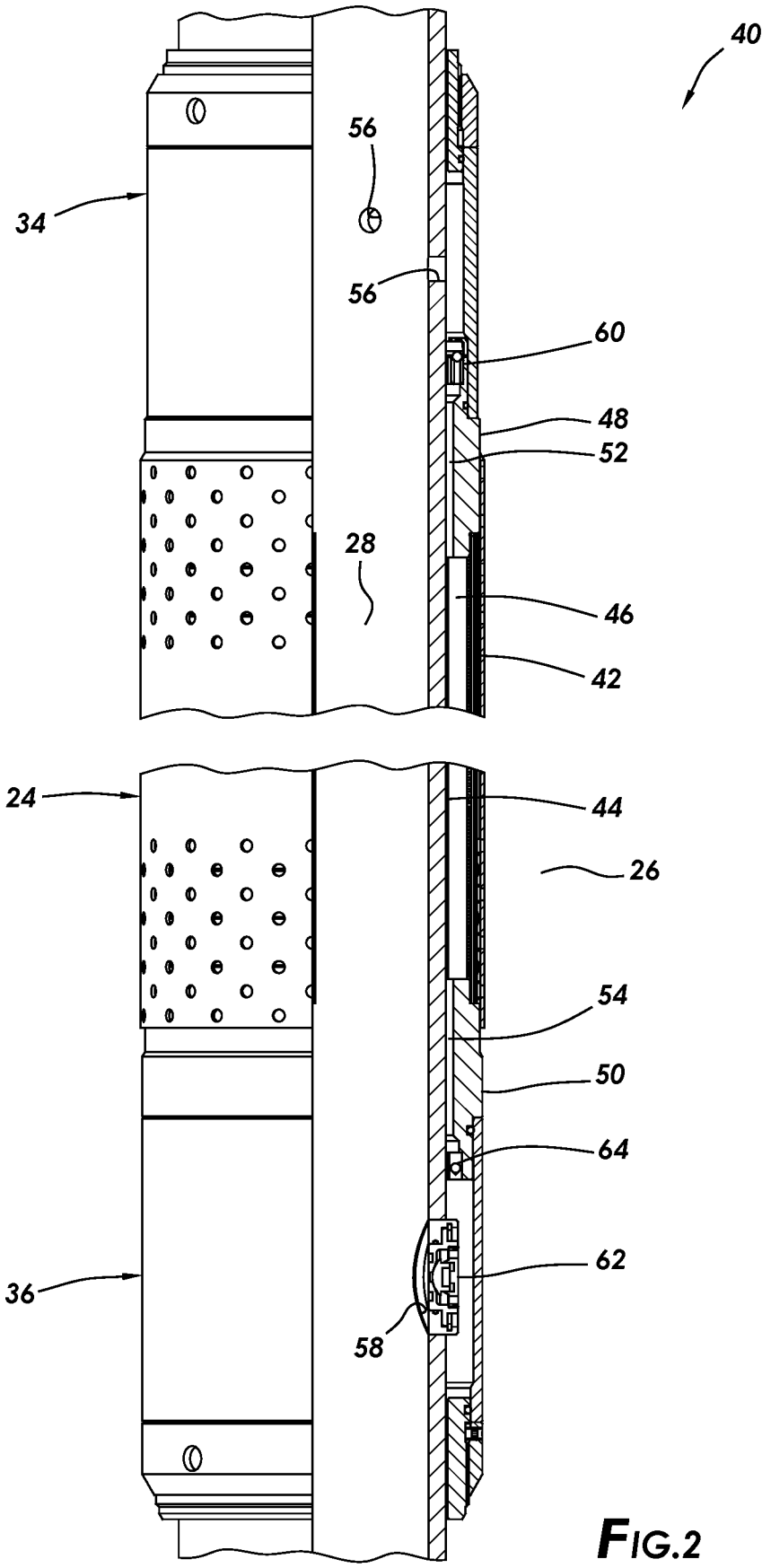
FIG. 2 is a representative cross-sectional view of an example of a well tool assembly that may be used with the system and method of FIG. 1, and which can embody the principles of this disclosure.

Referring additionally now to FIG. 2, a cross-sectional view of an example of a well tool assembly 40 that can incorporate the principles of this disclosure is representatively illustrated. In this example, the well tool assembly 40 incorporates the well screen 24, inflow control section 34 and outflow control section 36, and may be used in the FIG. 1 system 10 and method. However, it should be clearly understood that the well tool assembly 40 may be differently configured and may be used with other systems and methods, in keeping with the principles of this disclosure.

For convenience and clarity, the assembly 40 is described below as it may be used in the system 10 and method of FIG. 1. When the assembly 40 is used in other systems and methods, the details mentioned in the following description may be modified accordingly.

In the FIG. 2 example, the well screen 24 includes a generally tubular filter 42 surrounding a generally tubular base pipe 44. An annulus 46 is formed radially between the filter 42 and the base pipe 44.

The annulus 46 is closed off at its opposite ends by generally tubular bulkheads 48, 50. However, a fluid passage 52 allows fluid communication between the annulus 46 and the inflow control section 34, and another fluid passage 54 allows fluid communication between the annulus 46 and the outflow control section 36.

Ports 56 provide for fluid communication between the flow passage 28 and the inflow control section 34. An opening 58 provides for fluid communication between the flow passage 28 and the outflow control section 36.

In the inflow control section 34, an inflow control valve 60 controls flow between the fluid passage 52 and the ports 56. In the outflow control section 36, two outflow control valves 62, 64 control flow between the fluid passage 54 and the opening 58.

Figure 3:
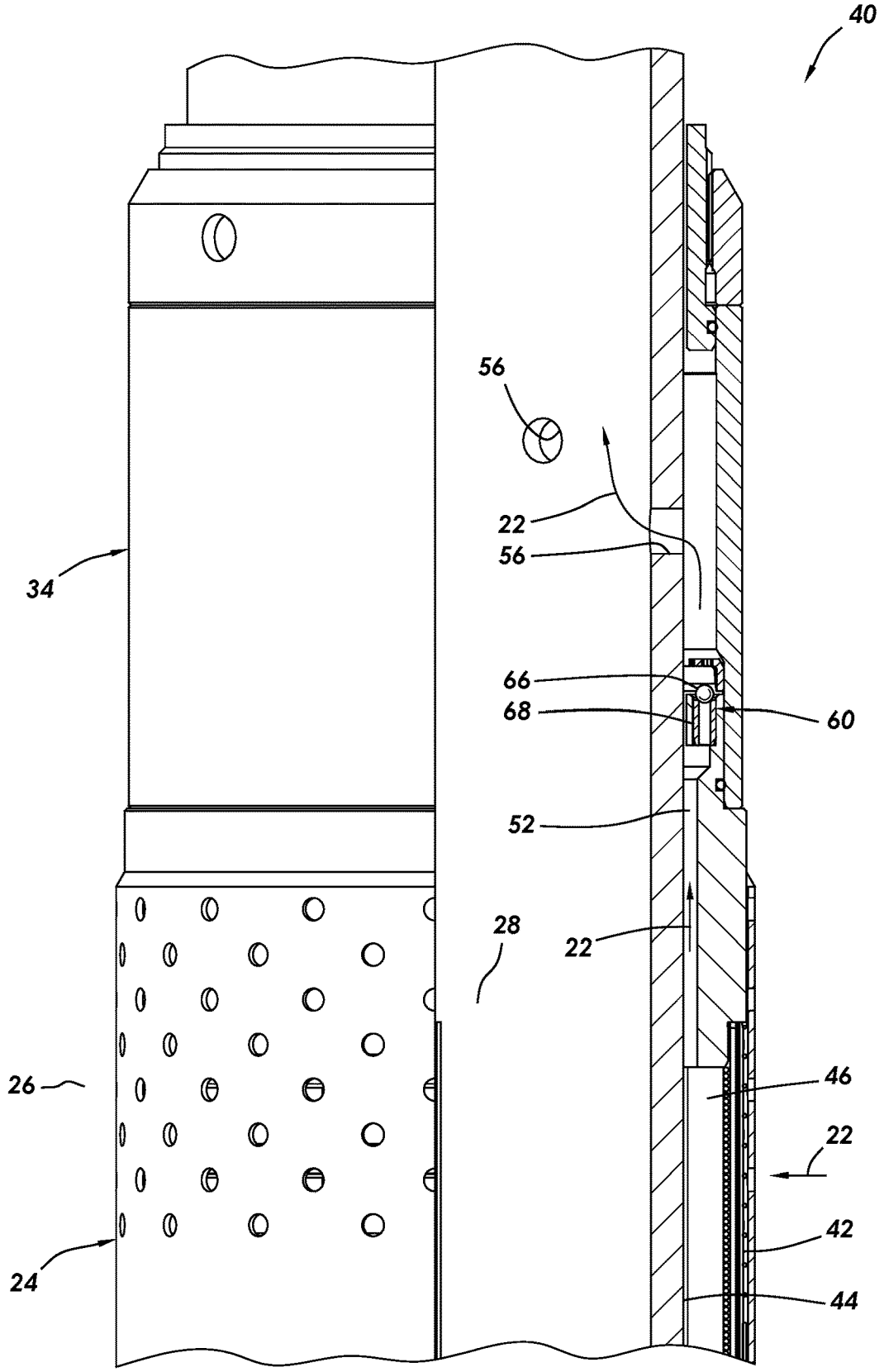
FIG. 3 is a representative cross-sectional view of a inflow control section of the well tool assembly.

Referring additionally now to FIG. 3, a cross-sectional view of the inflow control section 34 in the well tool assembly 40 is representatively illustrated. In this view, it may be seen that, when the fluid 22 is being produced, the fluid flows inwardly through the filter 42 of the well screen 24, into the annulus 46, and then via the fluid passage 52 to the inflow control section 34. The inflow control valve 60 permits the fluid 22 to flow from the fluid passage 52 to the ports 56, and then into the flow passage 28 for production to surface or a subsea facility.

In this example, the inflow control valve 60 comprises a check valve that permits this inwardly directed flow of the fluid 22, but prevents a reverse, outwardly directed flow. For this purpose, the inflow control valve 60 includes a ball or other type of closure member 66 that blocks any reverse, outwardly directed flow.

As depicted in FIG. 3, the closure member 66 can sealingly engage a seat formed on an end of a generally tubular nozzle 68. The nozzle 68 can be configured to restrict flow of the fluid 22 as desired (for example, to balance or otherwise regulate flow from a particular one of multiple zones, as discussed above). In this example, the level of restriction can be varied by correspondingly varying an inner diameter of the nozzle 68, varying a tortuosity of a flow path through the nozzle, placing obstructions to flow through the flow path, etc.

If a pressure on the exterior of the assembly 40 is greater than a pressure in the interior of the assembly, the inflow control valve 60 will open and thereby permit flow of the fluid 22 into the interior of the assembly (e.g., from the annulus 26 into the flow passage 28). If, however, the pressure in the interior of the assembly 40 is greater than the pressure on the exterior of the assembly (e.g., when the packer 30 is being set, the valve 32 is being actuated, or an injection or treatment operation is in progress), the inflow control valve 60 will close and thereby prevent flow through the inflow control section 34 from the interior to the exterior of the assembly (e.g., from the flow passage 28 into the annulus 26).

Figure 4:
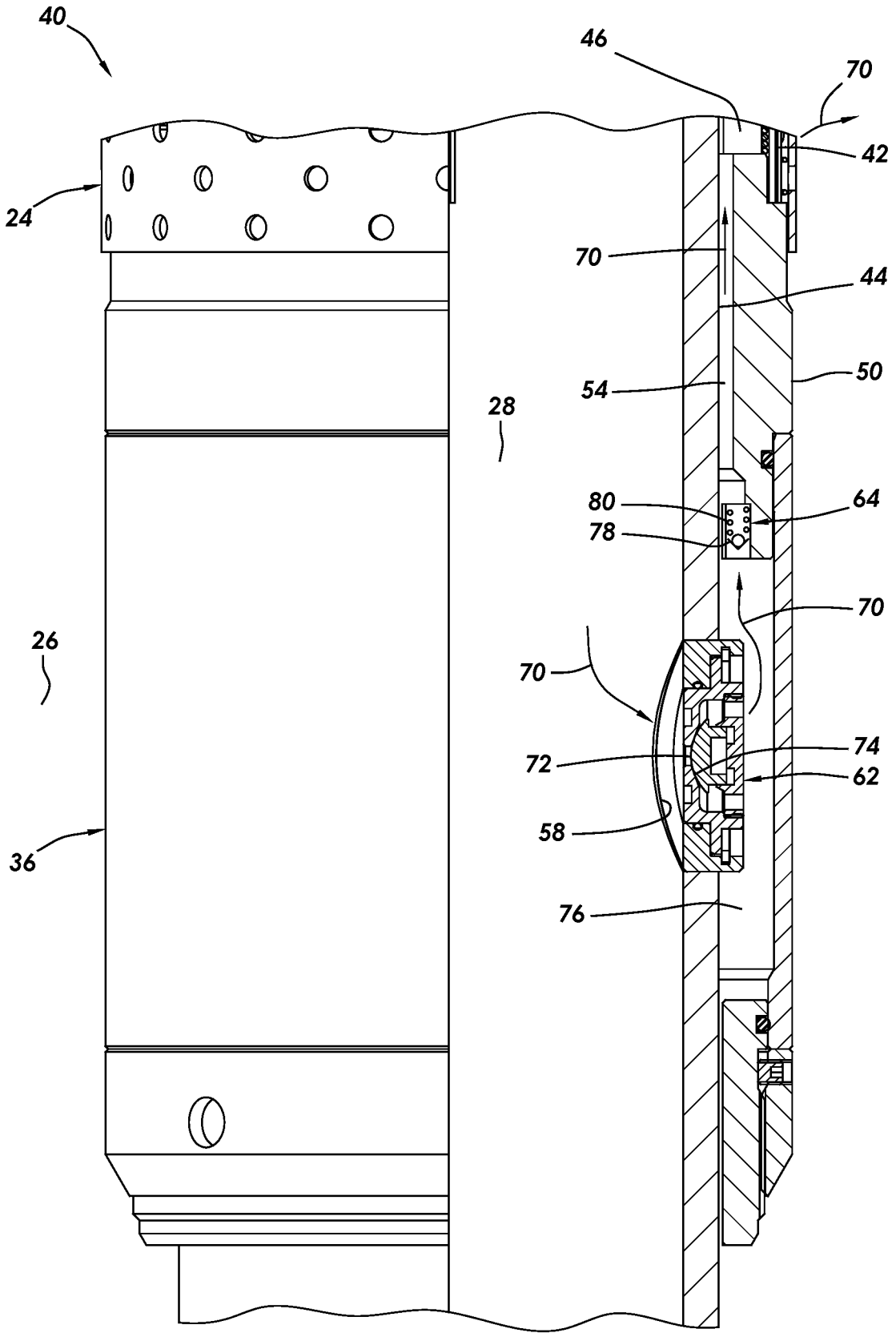
FIG. 4 is a representative cross-sectional view of an outflow control section of the well tool assembly.

Referring additionally now to FIG. 4, a cross-sectional view of the outflow control section 36 in the well tool assembly 40 is representatively illustrated. In this view, it may be seen that, when a fluid 70 is being injected, the fluid flows outwardly from the flow passage 28 via the outflow control valve 62 in the opening 58 and into the outflow control section 36. The fluid 70 then flows via the outflow control valve 64 into the fluid passage 54, and then via the annulus 46 and through the filter 42 to the exterior of the well tool assembly 40 (e.g., into the annulus 26).

In this example, the outflow control valve 62 comprises a check valve that permits this outwardly directed flow of the fluid 70, but prevents a reverse, inwardly directed flow. For this purpose, the outflow control valve 62 includes a poppet or other type of closure member 72 that blocks any reverse, inwardly directed flow.

As depicted in FIG. 4, the closure member 72 can sealingly engage a seat 74 of the outflow control valve 62. The seat 74 can be configured to restrict flow of the fluid 70 as desired (for example, to balance or otherwise regulate flow into a particular one of multiple zones, as discussed above). In this example, the level of restriction can be varied by correspondingly varying an inner diameter of the seat 74, varying a tortuosity of a flow path through the seat, placing obstructions to flow through the flow path, etc.

If a pressure in the interior of the assembly 40 is greater than a pressure on the exterior of the assembly, the outflow control valve 62 will open and thereby permit flow of the fluid 70 into the interior of the outflow control section 36 (e.g., from the flow passage 28). If, however, the pressure on the exterior of the assembly 40 is greater than the pressure in the interior of the assembly (e.g., when a production operation is in progress), the outflow control valve 62 will close and thereby prevent flow through the outflow control section 36 from the exterior to the interior of the assembly (e.g., from the annulus 26 into the flow passage 28).

In this example, preferably the outflow control valve 62 opens with a minimal pressure differential across the closure member 72. Thus, the outflow control valve 62 will open whenever a pressure in the flow passage 28 is greater than a pressure in the outflow control section 36 (e.g., in an internal chamber 76 providing fluid communication between the outflow control valves 62, 64).

The other outflow control valve 64 is connected in series with the outflow control valve 62. In this example, the outflow control valve 64 comprises a check valve 78 that is biased closed by a spring or other type of biasing device 80. In this manner, the outflow control valve 64 opens only if a pressure differential from the chamber 76 to the fluid passage 54 is greater than a predetermined level needed to overcome the biasing force exerted by the biasing device 80. The outflow control valve 64 is closed if the pressure differential from the chamber 76 to the fluid passage 54 is less than the predetermined level (or if there is a pressure differential from the fluid passage 54 to the chamber 76).

Thus, the FIG. 4 outflow control valve 64 is of the type known to those skilled in the art as a relief valve, with the relief pressure being the predetermined pressure differential level. In other examples, the outflow control valve 64 could be in the form of a relief valve that opens at the predetermined pressure differential level and, once opened, does not close (even if the pressure differential subsequently becomes less than the predetermined level).

In this example, preferably the outflow control valve 64 opens at the predetermined pressure differential level that allows another well operation to be performed prior to the outflow control valve 64 being opened. For example, the predetermined pressure differential level could be greater than a pressure differential at which the packer 30 is set. As another example, the predetermined pressure differential level could be greater than a pressure differential at which the valve 32 is actuated. As yet another example, the predetermined pressure differential level could be greater than a pressure differential at which the formation 20 fractures. As a further example, the predetermined pressure differential level could be greater than a pressure differential due to circulation of fluid through the tubular string 12 during installation in the wellbore 14. However, the scope of this disclosure is not limited to any particular relationship between the predetermined pressure differential level and a pressure differential at which any other well operation is performed.

As mentioned above, the outflow control valve 62 may present a restriction to the outward fluid flow through the outflow control section 36. Alternatively, or in addition, the outflow control valve 64 may present a restriction to the outward fluid flow through the outflow control section 36. If both of the outflow control valves 62, 64 present a restriction to the outward fluid flow, then in some examples the restriction presented by the outflow control valve 64 may be greater than the restriction presented by the outflow control valve 62.

Figure 5:
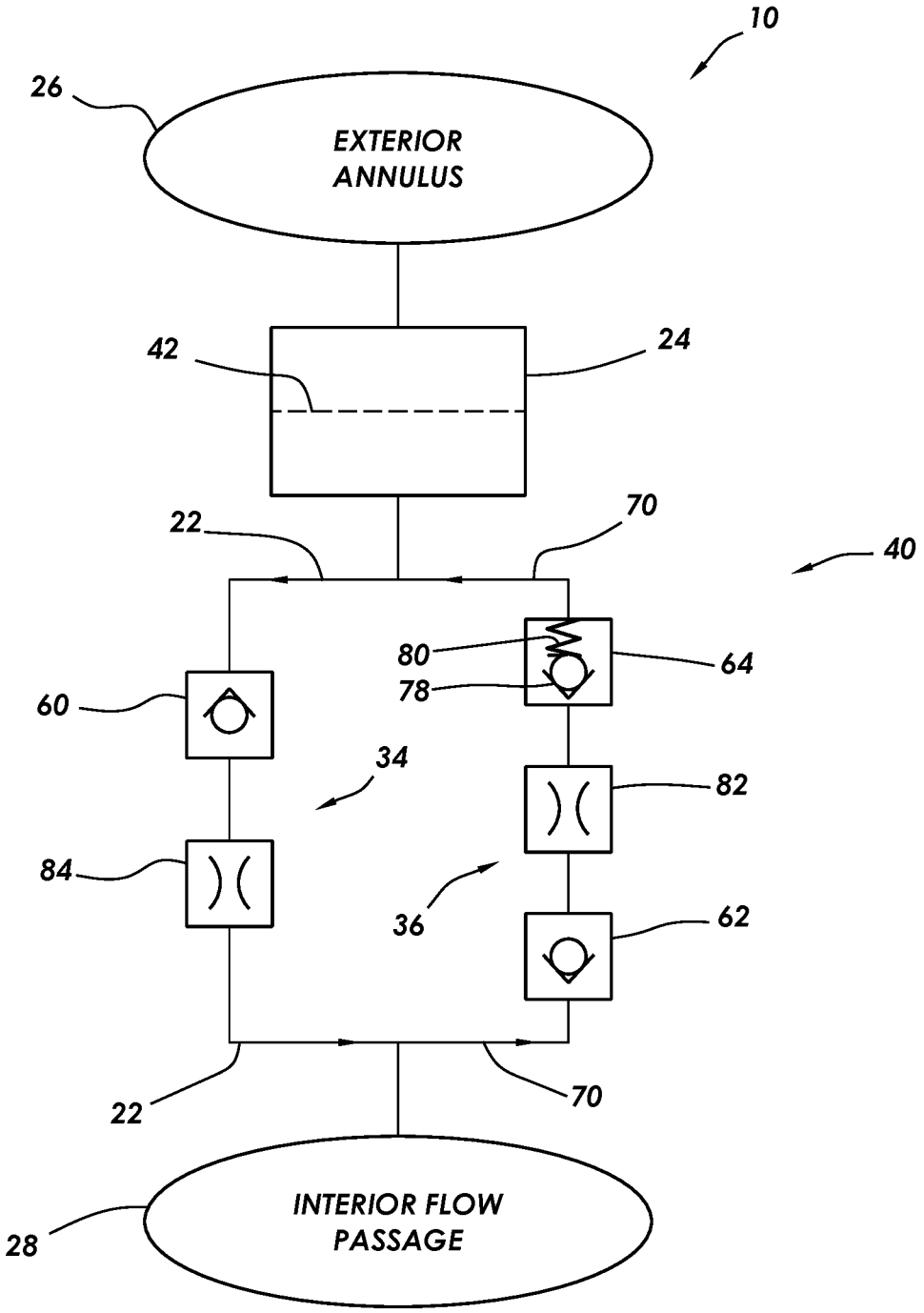
FIG. 5 is an example of a representative hydraulic circuit diagram for the well tool assembly.

Referring additionally now to FIG. 5, an example of a hydraulic schematic diagram is representatively illustrated for the well tool assembly 40 in the system 10. Although both of the fluids 22, 70 are depicted in FIG. 5, only one of the fluids would flow through the assembly 40 at any given time.

As will be appreciated from the FIG. 5 schematic diagram, the outflow control valves 62, 64 are connected in series. Thus, fluid 70 that flows through one of the outflow control valves 62, 64 can also flow through the other one of the valves.

As mentioned above, a flow restriction 82 may be incorporated into the outflow control section 36, for example, to balance or otherwise regulate the outward flow of the fluid 70 to the exterior of the assembly 40. The flow restriction 82 could be combined with the outflow control valve 62 or the outflow control valve 64, or it could be a separate component of the outflow control section 36.

As will also be appreciated from the FIG. 5 schematic diagram, the inflow control valve 60 is connected in parallel with the outflow control section 36. Thus, the fluid 22 can flow through the inflow control valve 60 without also flowing through either of the outflow control valves 62, 64.

As mentioned above, a flow restriction 84 may be incorporated into the inflow control section 34, for example, to balance or otherwise regulate the inward flow of the fluid 22 to the interior of the assembly 40. The flow restriction 84 could be combined with the inflow control valve 60 (such as, part of the nozzle 68), or it could be a separate component of the inflow control section 34.

Note that it is not necessary for both of the inflow and outflow control sections 34, 36 to be used in the assembly 40. For example, the outflow control section 36 could be used with the screen 24, without the inflow control section 34.

As mentioned above, it may be desirable to run or circulate the screen 24 into the well without an internal circulating string or wash pipe in the tubular string 12. In that case, the outflow control valve 64 can be set to open at a pressure differential higher than the circulating pressure differential to run the screen 24 into position in the well. When circulating, the closure member 66 of the inflow control valve 60 will block outwardly directed flow through the inflow control section 34. Thus, both of the inflow and outflow control sections 34, 36 (or either of the inflow and outflow control sections if one of these is used independently with the screen 24) will prevent flow from the interior flow passage 28 to the exterior annulus 26, thereby allowing circulating fluid to pass through the assembly 40 via the flow passage 28, out the toe (e.g., the distal end of the tubular string), and return to surface through the annulus 26.

It may now be fully appreciated that the above disclosure provides significant improvements to the art of controlling fluid flow between an interior and an exterior of a tubular string in a well. In examples described above, the well tool assembly 40 includes the inflow control section 34 that controls inward flow into the tubular string 12 and is able to do so separate from the outflow control section 36 that controls outward flow from the tubular string.

The above disclosure provides to the art a well tool assembly 40 for use in a subterranean well. In one example, the well tool assembly 40 can include a well screen 24 configured to filter fluid flow between an interior and an exterior of a tubular string 12 in the well, and an outflow control section 36 that permits the fluid flow in an outward direction and prevents the fluid flow in an inward direction. The outflow control section 36 includes first and second outflow control valves 62, 64 arranged in series.

The first outflow control valve 62 may be configured to open in response to any pressure differential from the interior to the exterior of the tubular string 12. The second outflow control valve 64 may be configured to open only in response to the pressure differential being greater than a predetermined level.

The first outflow control valve 62 may open at a first pressure differential from the interior to the exterior of the tubular string 12, and the second outflow control valve 64 may open at a second pressure differential from the interior to the exterior of the tubular string 12. The second pressure differential may be greater than the first pressure differential.

The second pressure differential may be greater than a third pressure differential required to set a packer 30 in the well. The second pressure differential may be greater than a third pressure differential required to fracture an earth formation 20 penetrated by the well. The second pressure differential may be greater than a third pressure differential required to open a pressure-actuated valve 32 connected in the tubular string 12.

The first outflow control valve 62 may present a first restriction to the fluid flow, and the second outflow control valve 64 may present a second restriction to the fluid flow. The second restriction may be greater than the first restriction.

The first outflow control valve 62 may comprise a check valve, and the second outflow control valve 64 may comprise a relief valve. The first and second outflow control valves 62, 64 may each comprise a check valve.

The well tool assembly 40 may include an inflow control valve 60 that prevents the fluid flow in the outward direction and permits the fluid flow in the inward direction. The inflow control valve 60 may restrict the fluid flow in the inward direction.

The inflow control valve 60 may be in parallel with the outflow control section 36. The inflow control valve 60 may comprise a check valve.

Also provided to the art by the above disclosure is a method for use with a subterranean well. In one example, the method may include installing a well tool assembly 40 in the well, the well tool assembly 40 including a well screen 24 configured to filter fluid flow between an interior and an exterior of a tubular string 12 in the well; flowing a first fluid 22 from the exterior to the interior of the tubular string 12, the first fluid 22 thereby flowing through the well screen 24 and an inflow control valve 60 of the well tool assembly 40; and flowing a second fluid 70 from the interior to the exterior of the tubular string 12, the second fluid 70 thereby flowing through the well screen 24 and a first outflow control valve 62 of the well tool assembly 40.

The method may include the inflow control valve 60 closing in response to the second fluid 70 flowing. The inflow control valve 60 may comprise a check valve that permits the first fluid 22 to flow from the exterior to the interior of the tubular string 12 through the inflow control valve 60 and prevents the second fluid 70 to flow from the interior to the exterior of the tubular string 12 through the inflow control valve 60.

The method may include the first outflow control valve 62 closing in response to the first fluid 22 flowing. The first outflow control valve 62 may comprise a check valve that permits the second fluid 70 to flow from the interior to the exterior of the tubular string 12 through the first outflow control valve 62 and prevents the first fluid 22 to flow from the exterior to the interior of the tubular string 12 through the first outflow control valve 62.

The second fluid 70 flowing step may include flowing the second fluid 70 from the interior to the exterior of the tubular string 12 through a second outflow control valve 64 of the well tool assembly 40. The method may include connecting the second outflow control valve 64 in series with the first outflow control valve 62.

The first outflow control valve 62 may open at a first pressure differential from the interior to the exterior of the tubular string 12, and the second outflow control valve 64 may open at a second pressure differential from the interior to the exterior of the tubular string 12. The second pressure differential may be greater than the first pressure differential.

The method may include setting a packer 30 in the well by applying a third pressure differential to the tubular string 12, the second pressure differential being greater than the third pressure differential.

The method may include fracturing an earth formation 20 by applying a third pressure differential to the tubular string 12, the second pressure differential being greater than the third pressure differential.

The method may include opening a pressure-actuated valve 32 in the well by applying a third pressure differential to the tubular string 12, the second pressure differential being greater than the third pressure differential.

The installing step may include applying a third pressure differential to the tubular string 12 due to circulating flow through the tubular string 12, the second pressure differential being greater than the third pressure differential.

The installing step may include preventing the fluid flow from the interior to the exterior of the tubular string 12 through the well screen 24. The installing step may be performed without a wash pipe in the tubular string 12.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method for use with a subterranean well, the method comprising:

installing a well tool assembly in the well, the well tool assembly including a well screen configured to filter fluid flow between an interior and an exterior of a tubular string in the well;

flowing a first fluid from the exterior to the interior of the tubular string, the first fluid thereby flowing through the well screen and an inflow control valve of the well tool assembly; and flowing a second fluid from the interior to the exterior of the tubular string, the second fluid thereby flowing through the well screen and first and second outflow control valves of the well tool assembly, in which the second outflow control valve is in series with the first outflow control valve.

2. The method of claim 1, further comprising the inflow control valve closing in response to the second fluid flowing.

3. The method of claim 1, in which the inflow control valve comprises a check valve that permits the first fluid to flow from the exterior to the interior of the tubular string through the inflow control valve and prevents the second fluid to flow from the interior to the exterior of the tubular string through the inflow control valve.

4. The method of claim 1, further comprising the first outflow control valve closing in response to the first fluid flowing.

5. The method of claim 1, in which the first outflow control valve comprises a check valve that permits the second fluid to flow from the interior to the exterior of the tubular string through the first outflow control valve and prevents the first fluid to flow from the exterior to the interior of the tubular string through the first outflow control valve.

6. The method of claim 1, in which the first outflow control valve opens at a first pressure differential from the interior to the exterior of the tubular string, and the second outflow control valve opens at a second pressure differential from the interior to the exterior of the tubular string, the second pressure differential being greater than the first pressure differential.

7. The method of claim 6, further comprising setting a packer in the well by applying a third pressure differential to the tubular string, the second pressure differential being greater than the third pressure differential.

8. The method of claim 6, further comprising fracturing an earth formation by applying a third pressure differential to the tubular string, the second pressure differential being greater than the third pressure differential.

9. The method of claim 6, further comprising opening a pressure-actuated valve in the well by applying a third pressure differential to the tubular string, the second pressure differential being greater than the third pressure differential.

10. The method of claim 6, in which the installing comprises applying a third pressure differential to the tubular string due to circulating flow through the tubular string, the second pressure differential being greater than the third pressure differential.

11. The method of claim 1, in which the first outflow control device presents a first restriction to the second fluid flow, and the second outflow control device presents a second restriction to the second fluid flow, the second restriction being greater than the first restriction.

12. The method of claim 1, in which the first outflow control valve comprises a check valve, and the second outflow control valve comprises a relief valve.

13. The method of claim 1, in which the first and second outflow control valves each comprise a check valve.

14. The method of claim 1, in which the installing comprises preventing the fluid flow from the interior to the exterior of the tubular string through the well screen.

15. The method of claim 1, in which the installing is performed without a wash pipe in the tubular string.

* * * * *